United States Patent [19]

Grossman

[11] Patent Number: 4,645,223

[45] Date of Patent: Feb. 24, 1987

[54] SKATEBOARD ASSEMBLY

[76] Inventor: Richard D. Grossman, 20519 Moberly Pl., Canoga Park, Calif. 91311

[21] Appl. No.: 703,766

[22] Filed: Feb. 21, 1985

[51] Int. Cl.[4] ..... A63C 17/02

[52] U.S. Cl. ..... 280/11.28; 280/87.04 A

[58] Field of Search ..... 280/11.12, 11.19, 11.27, 280/11.28, 87.04 R, 87.04 A, 113, 114, 125, 130, 725

[56] References Cited

U.S. PATENT DOCUMENTS

| | | | |
|---|---|---|---|
| 992,443 | 5/1911 | Oldfield | 280/11.27 |
| 4,061,350 | 12/1977 | Schmidt, Jr. et al. | 280/87.04 A |
| 4,123,080 | 10/1978 | Agajanian | 280/87.04 A |
| 4,194,752 | 3/1980 | Tilch et al. | 280/87.04 A |
| 4,402,521 | 9/1983 | Mongeon | 280/11.28 |
| 4,403,784 | 9/1983 | Gray | 280/11.28 |

FOREIGN PATENT DOCUMENTS

| | | | |
|---|---|---|---|
| 446783 | 2/1948 | Canada | 280/725 |

*Primary Examiner*—John J. Love
*Assistant Examiner*—Richard Camby
*Attorney, Agent, or Firm*—John J. Posta, Jr.

[57] ABSTRACT

The assembly includes a skateboard, a plurality of spaced wheel axles and rotatably secured sets of wheels and elongated resilient suspension frames connected at their opposite ends through housings to the wheel axles and to the underside of the skateboard. The assembly has at least four different shock-absorbing systems. Thus, the frames themselves absorb shock, as do cylinders of resilient rubber or the like set in cups connected to the frames above the wheel axles and bearing against the underside of the board. The wheel axle housings also include resilient dampeners which adjustably restrict steering rotation of the wheel axles and additionally dampen shocks. The frame housing connected to the underside of the skateboard rotatably receives the bases of the frames and adjustably controls that rotation, while providing a shock absorbing function, through the use of resilient bushing around the frame bases. The bushings are adjustably compressible thereagainst by adjustably tightening the frame housing against the underside of the skateboard. The assembly is simple, inexpensive, durable and efficient, imparting greatly improved riding and handling characteristics to the skateboard.

14 Claims, 6 Drawing Figures

SKATEBOARD ASSEMBLY

BACKGROUND OF THE INVENTION

1. Field of the Invention

The present invention generally relates to sports devices and, more particularly, to an improved skateboard assembly having novel efficient shock-absorbing components.

2. Prior Art

Conventional roller skateboards comprise a generally flat board supported in a horizontal position over spaced pairs of wheel-bearing axles by rigid truck assemblies. No special provision is made in those boards for shock absorbing. Consequently, the boards jiggle and vibrate as shocks are transmitted through the wheels, axles and trucks or housings. This can be tiring and dangerous, particulary when the surface being traversed is bumpy, e.g., uneven concrete pavement sections, etc. Skateboarding has reached a level of superior skill, many intricate high speed maneuvers being performed which require fine balance and timing. Heavy vibrations and shocks, however, seriously interfere with the ability of the skateboarder to execute such maneuvers, as well as the overall enjoyment of the sport.

Accordingly, there is a need for an improved skateboard which will provide a better, smoother ride and thus improve ride enjoyment, and will also provide greater safety and an increased ability to perform intricate high speed maneuvers. Such a skateboard should also provide improved shock-absorbing functions in an economical durable manner. The shock-absorbing should be controllable as to extent and location in order not to totally remove so-called road feel. The skateboard preferably should be adjustable for different skateboarder body weights and should permit fine tuning of its balance and steering functions for optimum performance.

SUMMARY OF THE INVENTION

The improved skateboard assembly of the present invention satisfies all the foregoing needs. The assembly is substantially as set forth in the Abstract above. Thus, the assembly includes a board, to which are attached preferably multiple wheel axles and wheels through a number of elongated axle suspension frames. Each frame is preferably tubular, generally triangular or the like and of light weight resilient metal capable of effectively absorbing shocks.

Each frame bears a wheel axle housing at one end and is rotatably connected by its base at its opposite end to a frame housing secured to the underside of the board. The wheel axle housing bears a tubular resilient shock absorber disposed in and extending up from a cup on upper surface, for contact with the underside of the board.

In addition, the axle housing has a transverse opening through which the wheel axle transversely extends and is pinned thereto for steering rotation in an about horizontal plane. The axle is locked in the opening by a resilient dampener pinned in place and restricting steering rotation. The dampener also provides a shock absorbing function. The extent of dampening and shock absorbing can be controlled by adjusting the longitudinal compression on the dampener. Resilient bushings which surround the tubular frame bases in the frame housing also provide an adjustable shock absorbing function. Those bushings are biased against the bases in order to controllably restrict movement of the frame. This is accomplished by forcing the frame housing up towards a plate secured between the board and housing, as by adjustably screwing the housing toward the board. The upper ends of the bushing are mashed by the plate so as to squeeze against the bases. This arrangement also provides a controlled shock-absorbing function. Loosening of the frame housing connection allows the frames to be freely rotated to a relatively flat stored position, once the shock absorbers are removed from the top of the axle housings.

Accordingly, a novel improved skateboard is provided which exhibits improved shock absorbability, rideability, safety, efficient performance and improved control over "road feel", steering characteristics, etc., all at low cost. The skateboard is durable and is compact and easily stored or transported. Further features are set forth in the following detailed description and accompanying drawings.

DRAWINGS

DETAILED DESCRIPTION

FIGS. 1–6

Figure 1:
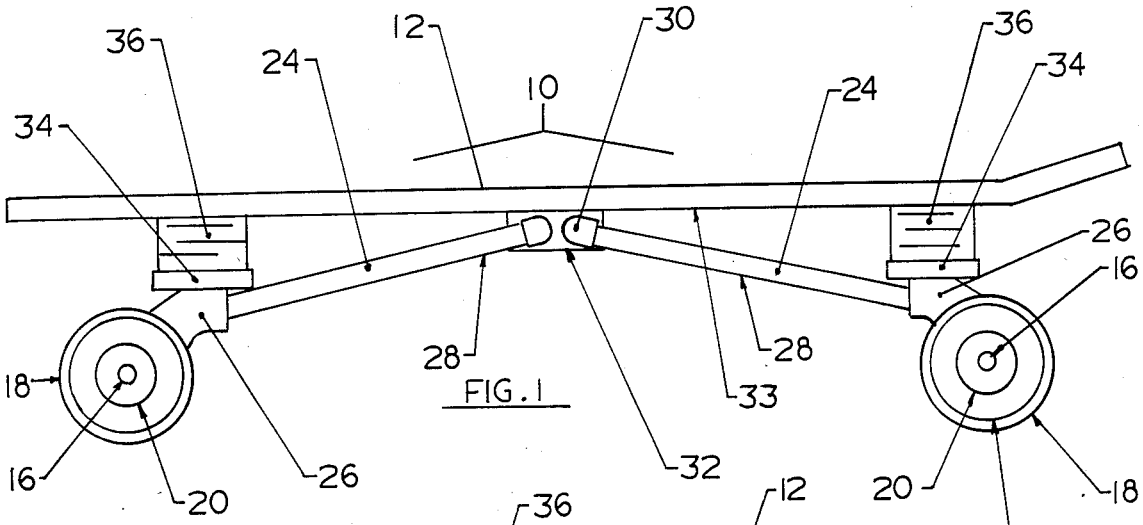
FIG. 1 is a schematic side elevation of a preferred embodiment of the improved skateboard assembly of the present invention.

Now referring more particulary to the accompanying drawings, FIG. 1 schematically depicts a preferred embodiment of the improved shock-absorbing roller skateboard assembly of the present invention in side elevation. Thus, assembly 10 is shown which comprises an elongated, generally flat board 12 of wood, metal, plastic, hard rubber or the like which is held in a horizontal position by an undercarriage 14.

Figure 2:
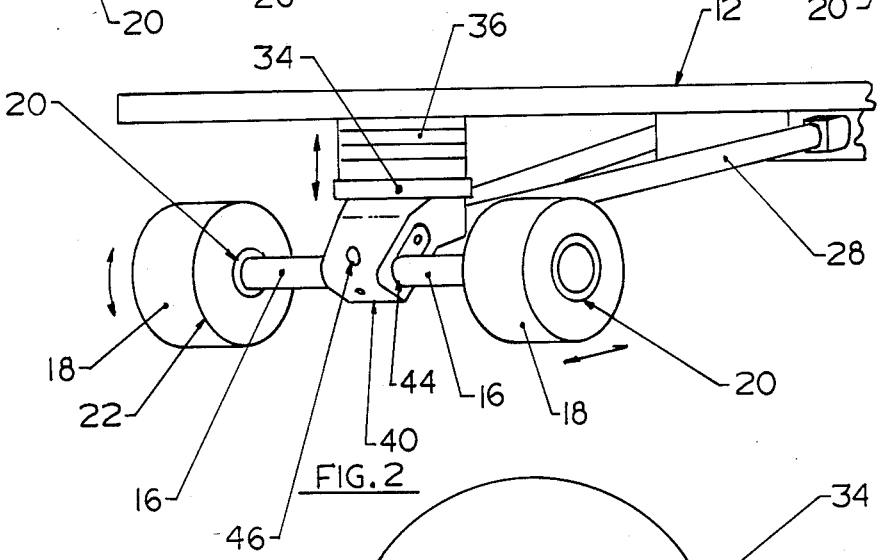
FIG. 2 is a schematic fragmentary front perspective view of the skateboard assembly of FIG. 1.
Figure 3:
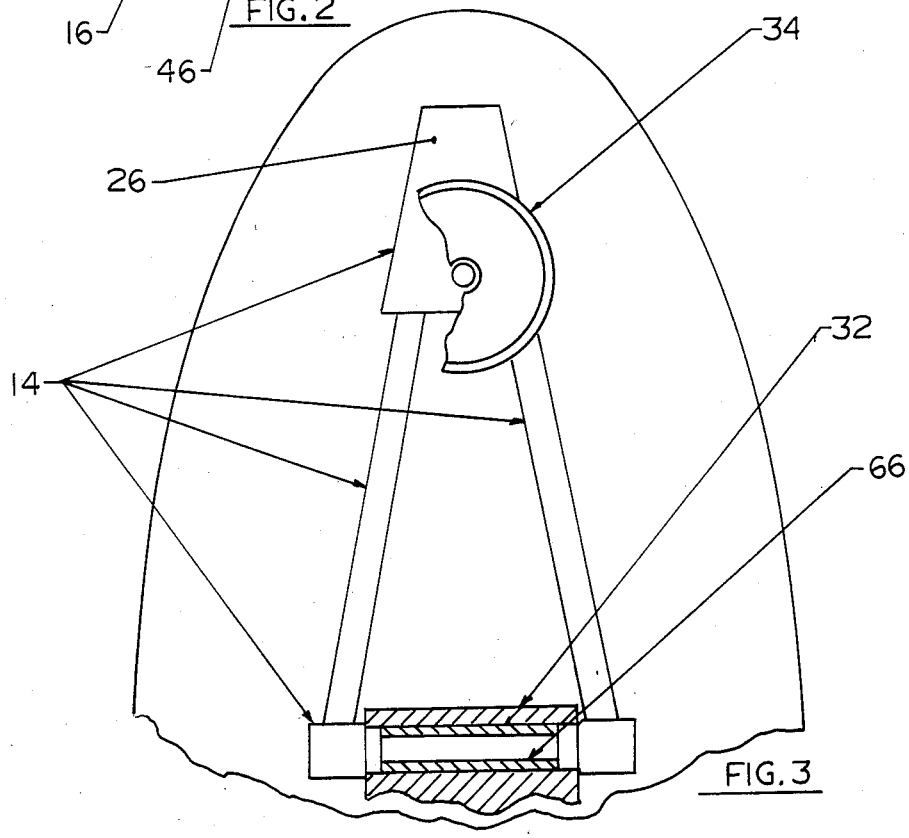
FIG. 3 is an enlarged, fragmentary schematic bottom plan view, partly broken away, of the frame and frame housing and board of the skateboard assembly of FIG. 1.

Undercarriage 14 comprises a spaced identical pair of transversely extending wheel axles 16 bearing wheels 18 at their outer ends (FIG. 2). Axles 16 may be of metal, or the like and wheels 18 preferably include metal cores 20 with polyurethane or other durable impack resistant synthetic or natural rubber or plastic covers or shells 22. Axles 16 are connected at the apexes of generally triangular tubular frames 24 through axle housings 26 secured to those apexes and preferably fabricated of metal, such as magnesium.

Each frame 24 preferably includes magnesium or other light weight structural metal tubing in the form of a pair of spaced diverging elongated struts 28 secured at one end to axle housing 26, extending longitudinally below board 12, and secured at the opposite end or base to a transversely extending arm 30. Struts 28 flex to absorb road shocks and thus effectively cushion the ride on assembly 10. Preferably both arms 30; that is, the arms of both frames 24, are disposed in a single frame housing 32 secured in a central location to the underside 33 of board 12, as shown in FIG. 1. Housing 32 preferably is of plastic or metal, such as magnesium, aluminum, etc.

Struts 28 slope downwardly from housing 32 towards the rear and front of assembly 10, positioning axle housings 26 and wheels 18 widely apart for maximum board stability. Struts 28 are held in the indicated sloped position because axle housings 26 bear on the tops thereof receivers which are preferably in the form of cups 34, containing resilient shock-absorbing columns 36 which extend upwardly therefrom and into contact with the underside 38 of board 12. Thus, columns 36 space wheels 18 from board 12. Cups 34 may be of metal, plastic or the like, and are screwed at otherwise secured to axle housings. Columns 36 preferably are cylinders of synthetic or natural rubber or resilient plastic or the like, for example, a stack of polyurethane rubber discs of selected compressibilities laminated together readily removable from cups 34 and interchangeable with other columns 36 having different compressibilities. The height, shape and overall compressibility of columns 36 will be dictated by the shape of cups 34, the weight of the person who is to use skateboard assembly 10, the desired shock-absorbing function, the desired "road feel" and other factors. Assembly 10 can be folded to a compact shape for easy storage or transport, merely by removing columns 36 from cups 34. Frames 24 and wheels 18 can be then be made to lie closely against underside 33 of board 12.

Figure 4:
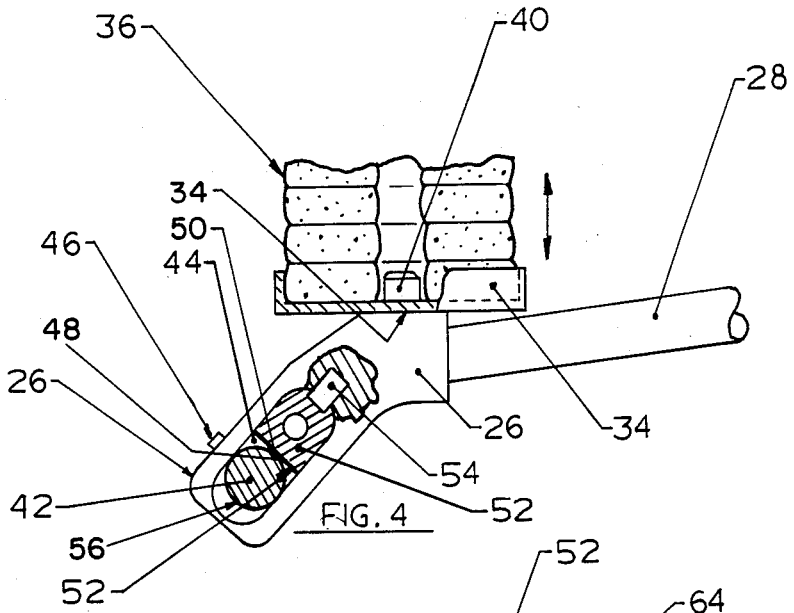
FIG. 4 is an enlarged schematic side elevation, partly broken away, of the wheel axle housing and shock absorber portions of the skateboard assembly of FIG. 1.
Figure 5:
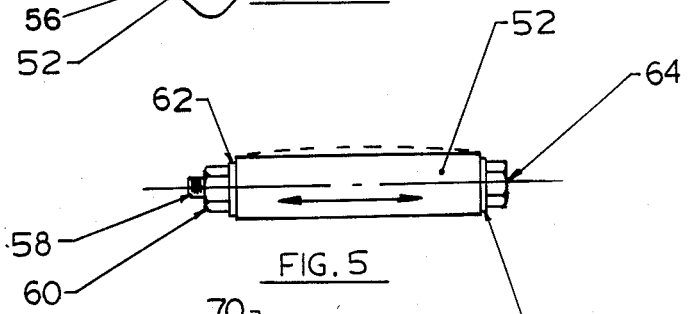
FIG. 5 is an enlarged schematic top plan view of the resilient dampener utilized in the axle housing of FIG. 4; and, FIG. 6 is an enlarged, fragmentary schematic side elevation, partly in section, of the frame housing and frame portions of the improved skatebaord assembly of FIG. 1.

Referring now more particularly to FIGS. 2, 4 and 5 of the drawings, a preferred form of interconnection of wheel axles 16 and frame 24 is illustrated schematically therein. Thus, axle housing 26 is shown being as elongated and generally downwardly sloped, but with a small horizontal upper area 38 upon which cup 34 is secured, as by pin 40. Adjacent the front sloped end 42 thereof, housing 26 defines an elongated opening 44 extending transversely therethrough. Axle 16 extends transversely through opening 44 and is rotatably pinned therein by a headed pin 46 extending down through housing 26, opening 44 and the upper part of axle 16.

It will be noted that axle 16 has a flat rear surface 48 which abuts a flat front surface 50 of an elongated flexible, resilient steering dampener 52 of polyurethane or other synthetic or natural rubber or plastic or the like pinned transversely in opening 44 by a forwardly extending pin 54 in housing 26. A rearwardly extending generally triangular section 56 is formed in housing 26 and extends into opening 44. The shape thereof permits axle 16 to pivot in a generally horizontal plane, in order to precisely steer assembly 10. Dampener 52 acts to restrict the steering range of axle 16 in order to make it more precise and controllable. Dampener 52, due to its resiliency, also provides a definite shock-absorbing action, dampening shock forces transmitted through axle 16.

Dampener 52 can be made adjustable relative to its steering dampening and shock-absorbing capabilities. Thus, dampener 52 can include a threaded bolt 58 extending longitudinally transversely therethrough, a nut 60 and a pair of washers 62 trapped between the opposite ends of dampener 52, and bolt head 64, in one instance and nut 60 in the other instance (FIG. 5). Screwing nut 60 toward head 64 compresses dampener 52 longitudinally, causing it to bulge forward, thus more tightly engaging surface 48 of axle 16 and exerting greater force to restrict the steering by axle 16 and also affect the absorbing function of dampener 52.

Figure 6:
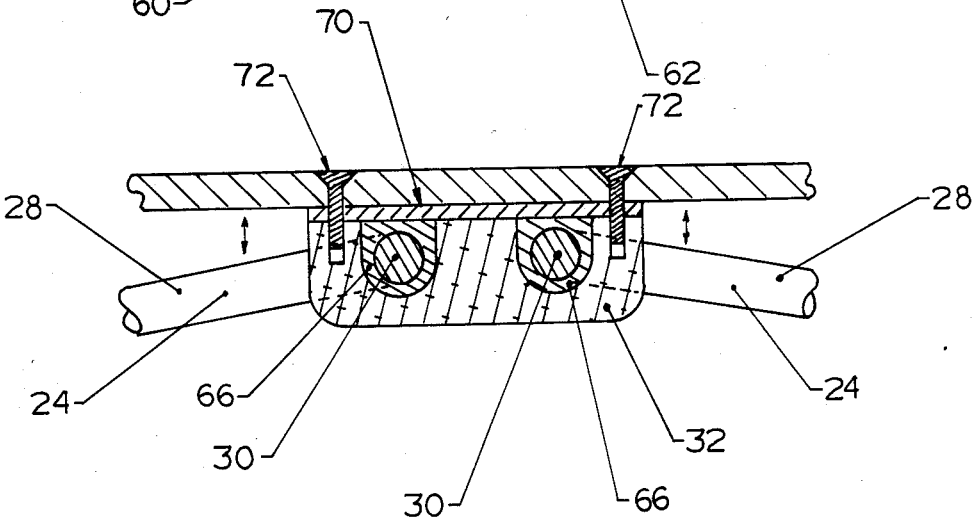

Referring more particularly to FIG. 6, a preferred manner of interconnection of board 12 and frames 24 is shown therein. Thus, frame housing 32 is shown to include a pair of transverse, cup shaped, open sided and open topped bushing chambers 66 which contain arms 30. Arms 30 have resilient bushings or sleeves 68 of polyurethane or other synthetic or natural rubber or plastic or the like slideably disposed therearound, filling bushing chambers 66 and extending up above the top level of housing 32. A sheet or plate 70 of hard or resilient rubber or the like preferably is interposed between housing 32 and board 12, and housing 32 is adjustably tightened thereagainst by screws 72 or the like threaded down through board 12, sheet 70 and the upper portion of housing 32. Thus, the spacing between plate 70 and housing 32 determines the degree of compression of bushings 68 by sheet 70 and thus the tightness with which bushings 68 grip arms 30 to restrict their rotating and vibratory movement and thereby to provide a shock-absorbing function. If desired, sheet 70 could be eliminated and board 12 could compress bushings 68 directly to provide essentially the same effect. However, sheet 70 exerts a slight shock absorbing effect of its own.

Accordingly, sheet 70, bushings 68, dampeners 52, columns 36 and struts 28 all perform shock-absorbing functions at various locations in assembly 10, with the principal shock-absorbing function being provided by columns 36. The net result is a smooth, safe, comfortable and enjoyable ride, with greater steering controllability and precision, and an increased ability to make safe high speed maneuvers. Assembly 10 is inexpensive and durable, the controlled shock cushioning effects provided by its various components substantially increasing its longevity. Various other advantages are set forth in the foregoing.

Various modifications, changes, alterations and additions can be made in the improved skateboard assembly of the present invention, its components and their parameters. All such modifications, changes, alterations and additions as are within the scope of the appended claims form part of the present invention.

What is claimed is:

1. An improved skateboard assembly, said assembly comprising, in combination:

(a) a skateboard;

(b) a pluality of spaced wheel axles disposed transversely below said board;

(c) wheels rotatably connected to opposite ends of said wheel axles;

(d) wheel axle suspending means connected to each of said wheel axles, each axle suspending means comprising an elongated frame disposed generally longitudinally of said skateboard, said frame having an axle member at a first end thereof generally transversely journalled in a housing connected to the underside of said skateboard at approximately the mid-point thereof, with the end opposite said first end of said frame being secured to one of said wheel axles; and, (e) wherein the ends of said frames opposite the first ends of said frames are disposed respectively under opposite ends of said skateboard, (f) a resilient shock absorber connected to and extending up above said frame and adapted to bear against the underside of said skateboard during operation thereof to improve its rideability, (g) wherein said frame is generally triangular, with the apex thereof connected to said wheel axle and the base thereof generally transversely disposed in a frame housing connected to the underside of said skateboard.

2. The improved skateboard assembly of claim 1 wherein said assembly comprises two of said wheel axles connected to two separate ones of said frame spaced along the length of said skateboard.

3. The improved skateboard assembly of claim 1 wherein said shock absorber comprises a resilient rubber cylinder, the lower end of which is disposed in a cup connected to the top of said frame adjacent said wheel axle.

4. The improved skateboard assembly of claim 3 wherein said cylinder comprises a stack of discs laminated together, said discs having predetermined degrees of compressability and dimensions.

5. The improved skateboard assembly of claim 1 wherein said frame includes a truck or housing having an opening extending transversely therethrough, in which a resilient steering dampener having shock absorbing capability is pinned and extends transversely of said opening, wherein said wheel axle is secured in said opening for steering rotation generally parallel to the plane of said skateboard and on one side thereof bears against said dampener which restricts said steering rotation, and on the opposite side thereof bears against a pivot point extending into said opening.

6. The improved skateboard assembly of claim 5 wherein said pivot point is defined by a cutaway portion in said opening, wherein said dampener has a flat face bearing against a flat face of said wheel axle and wherein a pin extends through said housing, said opening and said wheel axle to rotatably secure said wheel axle in said opening.

7. The improved skateboard assembly of claim 6 wherein said dampener is pinned in said opening against lateral slippage and wherein said dampener includes means to compress said dampener longitudinally, causing said dampener to controllably bulge against and controllably restrict steering rotation of said wheel.

8. An improved skateboard assembly, said assembly comprising, in combination:

(a) a skateboard;

(b) a plurality of spaced wheel axles disposed transversely below said board;

(c) wheels rotatably connected to opposite ends of said wheel axles;

(d) wheel axle suspending means connected to each of said wheel axles, each axle suspending means comprising an elongated frame disposed generally longitudinally of said skateboard, and rotatably secured adjacent one end thereof to the underside of said skateboard and adjacent the opposite end thereof to one of said wheel axles, and, (e) a resilient shock absorber connected to and extending up above said frame and adapted to bear against the underside of said skateboard during operation thereof to improve its rideability, (f) wherein said frame includes a truck or housing having an opening extending transversely therethrough, in which a resilient steering dampener having shock absorbing capability is pinned and extends transversely of said opening, (g) wherein said wheel axle is secured in said opening for steering rotation generally parallel to the plane of said skateboard and on one side thereof bears against said dampener which restricts said steering rotation, and on the opposite side thereof bears against a pivot point extending into said opening, (h) wherein said pivot point is defined by a cutaway portion in said opening, (i) wherein said dampener has a flat face bearing against a flat face of said wheel axle, and (j) wherein a pin extends through said housing, said opening and said wheel axle to rotatably secure said wheel axle in said opening, (k) wherein said dampener is pinned in said opening against lateral slippage and wherein said dampener includes means to comprise said dampener longitudinally, causing said dampener to controllably bulge against and controllably restrict steering rotation of said wheel, (l) wherein said dampener compression means comprises a threaded bolt extending transversely through said dampener, a nut on one end of said bolt and a washer between said nut and one end of said dampener and bearing thereagainst.

9. The improved skateboard assembly of claim 1 wherein said frame comprises resilient material and functions as a second shock absorber.

10. The improved skateboard assembly of claim 9 wherein said frame comprises a plurality of interconnected elongated magnesium struts.

11. An improved skateboard assembly, said assembly comprising, in combination:

(a) a skateboard;

(b) a plurality of spaced wheel axles disposed transversely below said board;

(c) wheels rotatably connected to opposite ends of said wheel axles;

(d) wheel axle suspending means connected to each of said wheel axles, each axle suspending means comprising an elongated frame disposed generally longitudinally of said skateboard and rotatably secured adjacent one end thereof to the underside of said skateboard and adjacent the opposite end thereof to one of said wheel axles; and, (e) a resilient shock absorber connected to and extending up above said frame and adapted to bear against the underside of said skateboard during operation thereof to improve its rideability, (f) wherein said frame comprises resilient material and functions as a second shock absorber, (g) wherein said frame is generally triangular with the apex thereof connected to said wheel axle and the base thereof generally transversely disposed in a frame housing connected to the underside of said skateboard.

12. The improved skateboard assembly of claim 11 wherein said base comprises an arm, wherein a resilient bushing is slideably disposed around said arm in a bushing chamber in said frame housing and extends above said frame housing, and wherein said frame housing is adjustably tightened up against said underside of said skateboard by adjustably tightening means running between said board and said frame housing, whereby adjustable compression of said arm bushing occurs, with consequent adjustable frictional resistance exerted by said arm bushing against rotation by said arm, thereby also effecting a shock absorbing action.

13. An improved skateboard assembly, said assembly comprising, in combination:

(a) an elongated skateboard;

(b) a pair of spaced wheel axles disposed transversely below said board;

(c) wheels rotatably secured to opposite ends of said wheel axles;

(d) a pair of spaced, elongated, tubular, resilient, shock absorbing metallic suspension frames, each of said frames bearing a wheel axle housing having a transverse opening through which one of said axles extends and is pinned thereon, for rotation in a generally horizontal plane for steering purposes, and the flat rear face of said axle abutting the flat front face of a resilient steering dampener pinned in said opening behind said axle to effect a shock absorbing function, the base of both said frames being rotatably disposed in a single frame housing secured adjustably to the underside of said skateboard, said frame housing including a pair of transverse spaced bushing chambers receiving said bases and resilient bushings disposed therearound, said bushings normally extending above said housing into contact with a compression sheet between said housing and skateboard underside, tightening of said frame housing up to said sheet controllably compressing said compression bushings around said bases to restrict their rotation and for a shock-absorbing function; and, (e) a resilient generally cylindrical resilient shock absorber of controlled compressibility releasably secured in a cup on the top of each wheel axle housing and extending upwardly therefrom towards the underside of said skateboard for maximum shock-absorbing capability.

14. The improved skateboard assembly of claim 13 wherein said frames each comprise magnesium, one of said frames facing rearwardly and the other of said frames facing forwardly to dispose said wheels below the front and rear ends of said skateboard, wherein said steering dampener includes means to adjustably compress it longitudinally in order to bulge it into increased compressive contact with said wheel axle to restrict the steering rotation thereof, wherein said dampener, frame bushings and shock absorber cylinder comprise rubber, and wherein said frames are foldable to a generally flat stored position after loosening said frame housing and removal of said shock absorbing cylinders.

* * * * *